US007461661B2

(12) United States Patent
Chudzik et al.

(10) Patent No.: US 7,461,661 B2
(45) Date of Patent: Dec. 9, 2008

(54) HAIR CLIP WITH FRICTION MEMBER

(75) Inventors: Stan Chudzik, Alpharetta, GA (US); Michael Defenbaugh, Marietta, GA (US)

(73) Assignee: Goody Products, Inc., Atlanta, GA (US)

( * ) Notice: Subject to any disclaimer, the term of this patent is extended or adjusted under 35 U.S.C. 154(b) by 136 days.

(21) Appl. No.: 11/330,630

(22) Filed: Jan. 12, 2006

(65) Prior Publication Data

US 2006/0162738 A1 Jul. 27, 2006

Related U.S. Application Data

(60) Provisional application No. 60/643,198, filed on Jan. 12, 2005.

(51) Int. Cl.
*A45D 8/00* (2006.01)
*A45D 8/22* (2006.01)

(52) U.S. Cl. ..... 132/273; 132/278

(58) Field of Classification Search ..... 132/278, 132/273, 276–277, 279; 24/300, 556, 507, 24/521, 564
See application file for complete search history.

(56) References Cited

U.S. PATENT DOCUMENTS 2,661,748 A 12/1953 Racho
2,767,721 A 10/1956 Cockley
3,590,830 A 7/1971 Hannum
5,445,170 A * 8/1995 Yasuda ..... 132/279
5,477,870 A 12/1995 Menaged
5,638,836 A 6/1997 Yasuda
5,819,356 A * 10/1998 Cann ..... 15/120.1
5,996,593 A 12/1999 Horman
6,257,251 B1 7/2001 Burleson et al.
6,394,102 B1 5/2002 Vogel
2003/0221700 A1 12/2003 La Fauci
2004/0065341 A1 4/2004 La Fauci

OTHER PUBLICATIONS

WO 00/13544 Jean Pierre Veiniere, Anti Slip Hair Clip, Mar. 16, 2000.*

* cited by examiner

*Primary Examiner*—Robyn Doan
(74) *Attorney, Agent, or Firm*—Gardner Grogg Greenwald & Villanueva, PC

(57) ABSTRACT

A hair retaining clip includes a base, a locking arm, a hinge, and a locking mechanism. The base includes a first end, a second end and a first elongate section that is resiliently movable relative to the base. The locking arm includes a first end, a second end, and a second elongate section that operatively engages the first elongate section in a closed position. The hinge is disposed on and pivotally connects the first ends of the base and the locking arm. The locking mechanism is disposed on the second ends of the base and the locking arm for locking the clip in a closed position. At least one of the first and second elongate sections are entirely constructed from a high friction material.

18 Claims, 9 Drawing Sheets

HAIR CLIP WITH FRICTION MEMBER

RELATED APPLICATION DATA

The present application is a non-provisional application based on, and claims the priority benefit of, co-pending U.S. provisional application Ser. No. 60/643,198, which was filed on Jan. 12, 2005, and is expressly incorporated herein by reference.

TECHNICAL FIELD

The present disclosure relates generally to a device for clasps and clips for retaining strands of hair and, more particularly, to clasps and clips having a friction member for improved gripping of the strands of hair.

BACKGROUND OF THE DISCLOSURE

Devices for retaining hair, such as barrettes, bobby pins, claw clips, and hair clips, are generally known in the art. These devices come in various shapes and sizes including various adornments to improve the esthetic appeal of the hair retaining device. One of the ongoing difficulties with these devices, however, is the inability to prevent these devices from sliding off of or moving relative to the strands of hair to be engaged and retained by the devices. For example, during normal movement throughout the day these devices tend to loose their grip around the strands of hair, thereby loosening the bundle of hair the devices are intended to retain.

One such device is disclosed in U.S. Pat. No. 6,257,251 to Burleson et al. which discloses a cushion coated hair clip having low friction surfaces. The hair clip includes a layer of compressible, resilient cushion material such as natural rubber or elastomer synthetic resin material, or cellular plastic foam that is bonded onto the hair engaging surfaces. A thick non-porous outer coating layer is applied to the compressible cushion layers for providing smooth, low friction, non-sticking surfacing for directly engaging the hair.

Another such device is disclosed in U.S. Pat. No. 5,996,593 to Horman which discloses a hair clip. The hair clip includes an alternating sequence of rubber teeth secured to surfaces of each of two clamping arms which are in an interlocking mating relationship, thereby providing for a greater surface area between the clamping arms of the hair clip.

Another such device is disclosed in U.S. Pat. No. 3,590,830 to Hannum which discloses a barrette. The barrette includes a pair of hingedly connected outer and inner body members. The first body member is provided with means for grippingly, non-slidably engaging the hair of the wearer. The other body member is provided with lifting means, including means for manually retracting and extending the lift means relative to the body member to permit unhindered insertion of the body member in the hair of the user.

These and similar retaining devices, however, do not provide the desired gripping ability for retaining a bundle of hair, or are too costly to manufacturer, and/or cause damage to the user's hair.

SUMMARY OF THE DISCLOSURE

In accordance with one aspect of the disclosure, a hair retaining clip having a base, a locking arm, a hinge, and a locking mechanism is disclosed. The base includes a first end, a second end and a first elongate section that is resiliently movable relative to the base. The locking arm includes a first end, a second end, and a second elongate section that operatively engages the first elongate section in a closed position. The hinge is disposed on and pivotally connects the first ends of the base and the locking arm. The locking mechanism is disposed on the second end of base for locking the clip in a closed position. At least one of the first and second elongate sections are entirely constructed from a high friction material.

In accordance to another aspect of the disclosure, a hair retaining clip having a base, a locking arm, a hinge, a locking mechanism, and an insert is disclosed. The base includes a first end, a second end and an elongate section that is resiliently movable relative to the base. The locking arm includes a first end, a second end, and an elongate web that operatively engages the elongate section in a closed position. The hinge is disposed on and pivotally connects the first ends of the base and the locking arm. The locking mechanism is disposed on the second end of the base for locking the clip in a closed position. The insert is disposed in an aperture of the web and is constructed from a high friction material.

In accordance to another aspect of the disclosure, a hair retaining clip having a base, a locking arm, a hinge, a locking mechanism, and a gripping portion is disclosed. The base includes a first end, a second end and a first elongate section that is resiliently movable relative to the base. The locking arm includes a first end, a second end, and a second elongate section that operatively engages the first elongate section in a closed position. The hinge is disposed on and pivotally connects the first ends of the base and the locking arm. The locking mechanism is disposed on the second end of the base for locking the clip in a closed position. The gripping portion is permanently attached to at least one of the first and second elongate sections.

Figure 1:
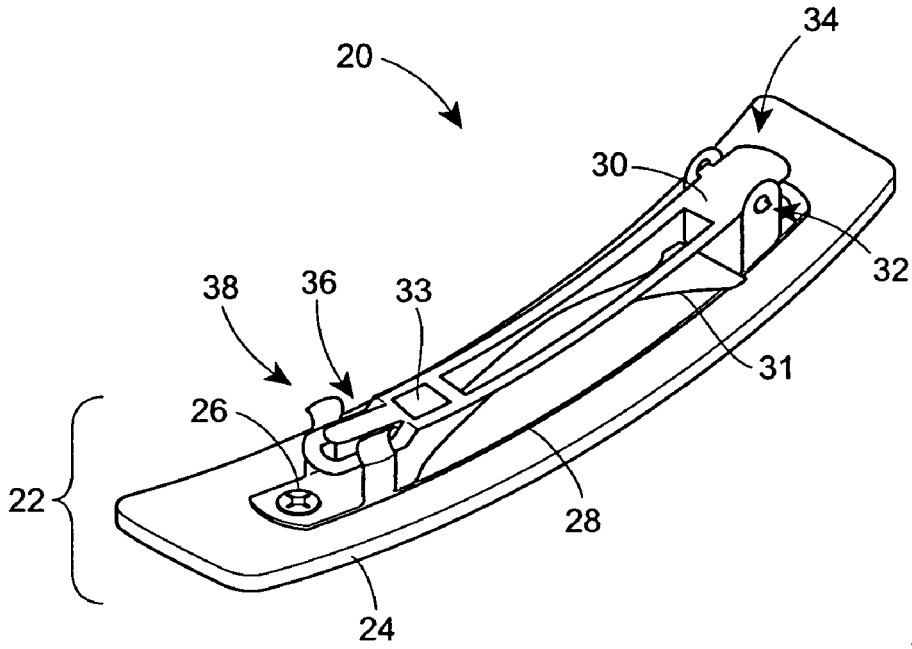
FIG. 1 is an isometric view of a hair retaining clip in a closed position according to one embodiment of the disclosure.

While the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure and the appended claims.

DETAILED DESCRIPTION

Figure 2:
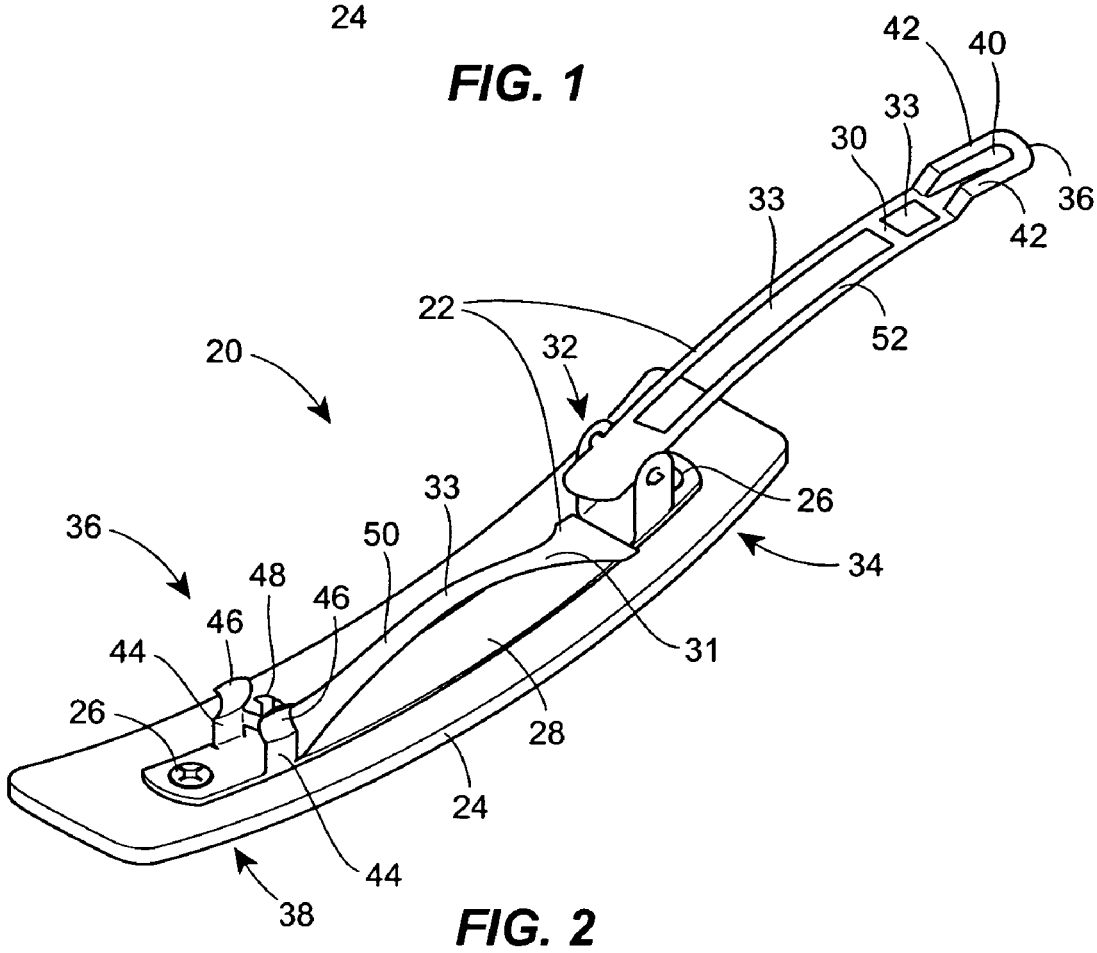
FIG. 2 is an isometric view of the hair retaining clip of FIG. 1 in an open position.
Figure 3:
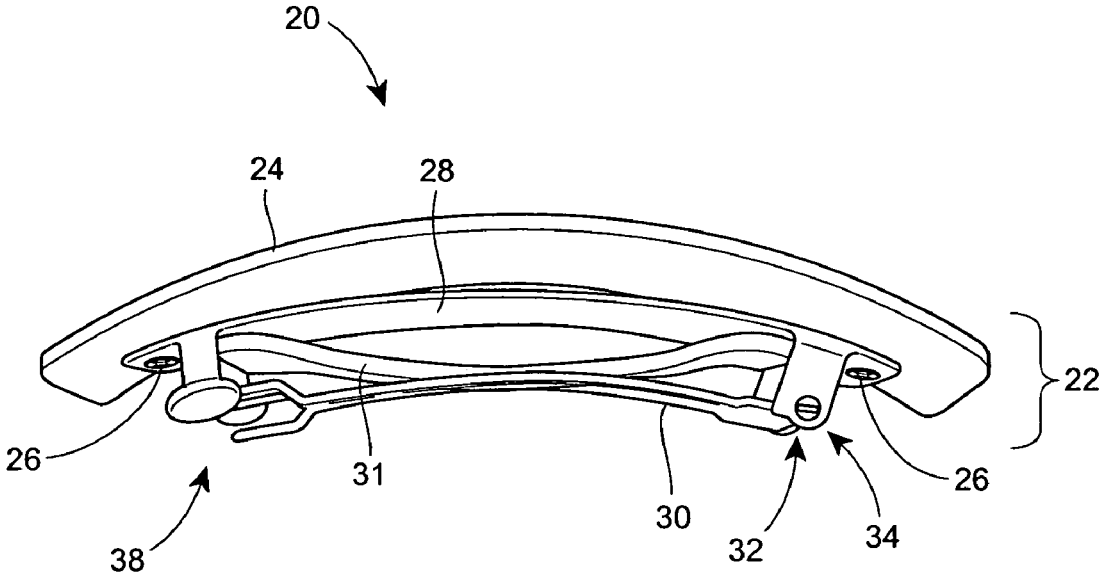
FIG. 3 is a side isometric view of the hair retaining clip of FIG. 1 in a closed position.

Referring now to the drawings and with specific reference to FIGS. 1-3, a hair clip constructed according to the teachings of the disclosure is generally depicted by reference numeral 20. As shown therein, the hair clip 20 in this exemplary embodiment includes a fastener 22 fixedly attached to a shroud 24. The shroud 24 may be attached to the fastener 22 in various ways known to those skilled in the art, and in this exemplary embodiment is fastened to the fastener 22 via screws 26. The shroud 24 may be a separate piece from the fastener 22 and may, in an alternative embodiment, be constructed in one unitary or over-molded piece.

The fastener 22 includes a base 28 operatively connected to a locking arm 30. The base 28 has a generally elongate shape and is fixedly attached to the shroud 24. The base 28 also includes a spring or biasing member 31 that may be slidably and/or fixedly connected to the base 28. The spring member 31 has a generally elongate shape and, in this embodiment, is constructed from a high friction or non-slip material such as, for example, Styrene, Polypropylene, Polyethylene, Styrene, Nylon, Kostrate, Styrene Acrylonitrile (SAN), Polyvinyl Chloride (PVC), Acetate, Neoprene or a Thermoplastic Elastomer (TPE) material. The spring member 31 may also include a thinning or reduced center section, which may be adapted to engage the base 28, as seen in FIG. 3, and may possess a variety of textures and geometries that would provide an increased holding power. Furthermore, as seen in FIG. 2, the spring member 31 may include a bow or curvature, such that spring member 31 can absorb a force placed on the fastener 22 when the clip 20 is in a closed position similar to FIGS. 1 and 3. The locking arm 30 also has a generally elongate shape and may include one or more apertures 33 that may receive portions of the spring member 31.

A hinge or pivot mechanism 32 is disposed at a first end 34 of the fastener 22 and pivotally connects the base 28 to the locking arm 30. A locking mechanism 36 is disposed at a second end 38 of the fastener 22 that secures or locks the fastener 22 in a closed position. In other words, the base 28 has a hinge 32 that pivotally engages the locking arm 30 at one end, and the clasp or locking mechanism 36 that engages an opposite (free) end of the locking arm 30 to secure the locking arm 30 relative to the base 28. The hair clip 20, as seen in FIG. 2, is in an open position thereby providing a detailed view of the locking mechanism 36. The locking mechanism 36 includes a pair of locking arms 44 that are integrally formed with and extend upwardly from with the base 28. The locking arms 44 each include a button 46 disposed at the end thereof, and a hook 48 disposed between the button 46 and the base 28. The free end of the locking arm 30 includes a slot 40 that is defined by a pair of locking tabs 42 (FIG. 2). In operation, to close the fastener 22, the locking mechanism 36 is pressed towards the free end of the locking arm 30, thereby locking the fastener 22. Specifically, as the free end of the locking arm 30 is pressed against the locking mechanism 36, the hooks 48 are forced together by engagement with and deflection of the arms 44 into the slot 40 until the locking tabs 42 pass the hooks 48, at which time the hooks 48 engage the locking tabs 42 to retain the locking arm 30 in the closed position. To open the fastener 22, the user presses the buttons 46 inwardly toward each other until the hooks 48 disengage from the locking tabs 42 to release the locking arm 30. Once the buttons 46 are released, the arms 44 will return to their original position.

An operation of the hair clip 20 will be herein described as retaining a bundle of hair (not shown), but it should be understood that the hair clip 20 may be used to retain, hold, or be disposed on a variety of objects in a variety of ways. As best illustrated in FIGS. 2 and 3, a user may engage an open clip 20 with a bundle of hair, such that an inner spring surface 50 (FIG. 2) abuts a first portion of the bundle of hair (not shown). The user may then close the clip 20 by engaging an inner surface 52 of the locking arm 30 (FIG. 2) with a second portion of the bundle of hair (not shown), and engage the locking mechanism 36 with the free end of the locking arm 30, thereby closing the clip 20. As a result, the bundle of hair is retained in the clip 20. Additionally, the high friction or non-slip material of which the spring member 31 is constructed will aid in the retention of hair in the hair clip 20, as the high friction or non-slip material will provide addition gripping ability of the hair compared to previous constructions.

The above exemplary embodiment may be varied or altered to achieve and create similar, additional or alternative features. For example, even though the above exemplary embodiment is describing a certain type of hair clip, the sprit and scope of the invention covers other types of hair clips, such as other types of barrettes, snap clips, living hinge clips, etc. For example, barrettes or other hair clips currently on the market, could be altered by applying a gripping or friction member.

The gripping member for solid hair accessories, such as wood, plastic, or metal, can be achieved by coating the hair accessory with a vinyl or epoxy type product, lining or wrapping the product with a rubber or other gripping material including Velcro®, or by manufacturing a product that has two components (i.e. a two shot injection molding machine where a TPE coating is applied over a plastic part). The gripping member can be applied during the initial manufacturing step or in a secondary operation.

Figure 4:
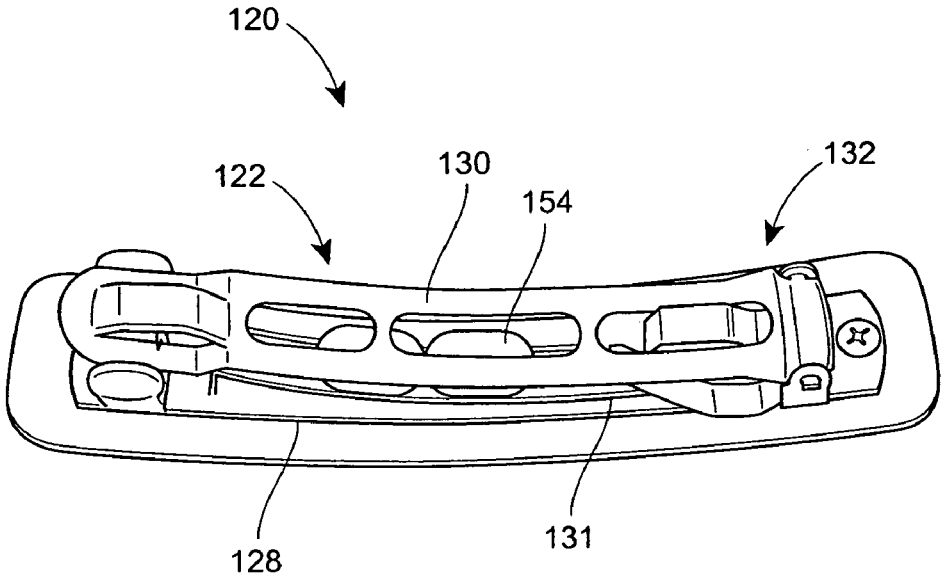
FIG. 4 is an isometric view of a hair retaining clip of FIG. 1 in a closed position according to another embodiment of the disclosure.
Figure 5:
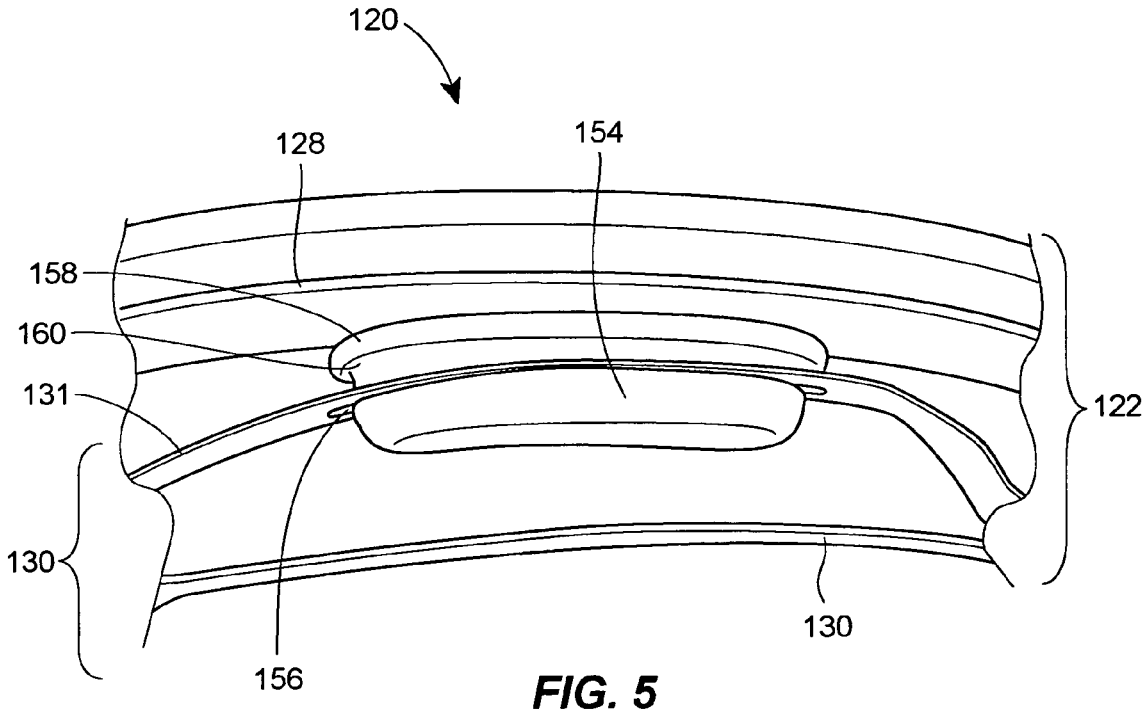
FIG. 5 is a detailed side isometric view of the hair retaining clip of FIG. 4.
Figure 6:
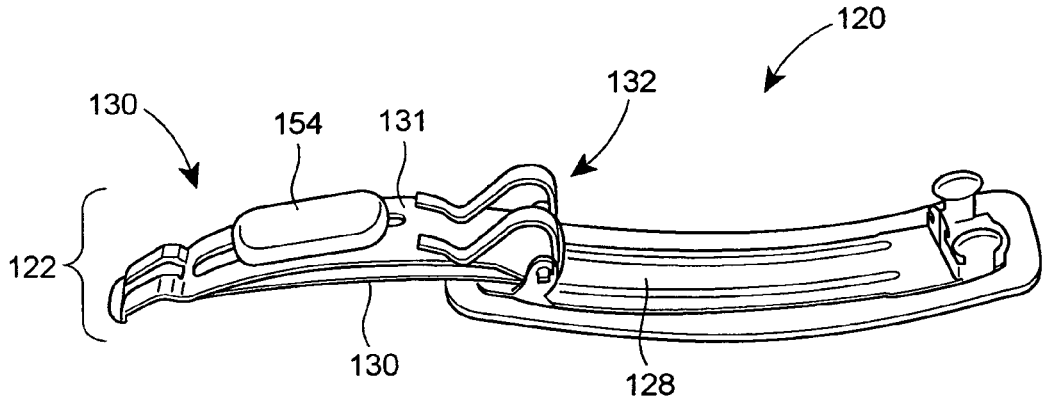
FIG. 6 is a isometric view of the hair retaining clip of FIG. 4 in an open position.

In the embodiment shown in FIGS. 4-6, a hair clip 120 includes a fastener 122 having a base 128 pivotally connected to a locking arm 130 via a hinge 132. In this exemplary embodiment, the spring member 131 is part of the locking arm 130 as opposed to the base 28 of the previous embodiment, and includes an insert or plug 154 disposed in an aperture 156 (FIG. 5) of the spring member 131. Additionally and/or alternatively, the insert 154 may be disposed on other components of the hair clip 120, such as base 128 or the locking arm 130, depending on the construction and placement of the spring member 131. The insert 154, as best seen in FIG. 5, includes an inner portion 158 for abutting the strands or bundle of hair, and a groove 160 for engaging the aperture 156. The insert 154 may be used to retrofit or update existing hair clips 120 having at least one aperture 156, with the insert 154 being press fit into the aperture 156.

The insert 154 may be designed in a variety of shapes and sizes and possess a variety of textures that can improve the holding power of the hair clip 120. The materials that may be used are "soft" such as natural rubber, neoprene, santoprene, TPE, silicone, nylon, etc. The processes that can produce these insert, plugs, or snap-over pieces 154 may be injection molded, extruded, stamped and casted. The insert 154 may also be designed to be a harder plastic insert possessing bumps, ridges, or any form of geometry to increase surface area for gripping.

Figure 7C:
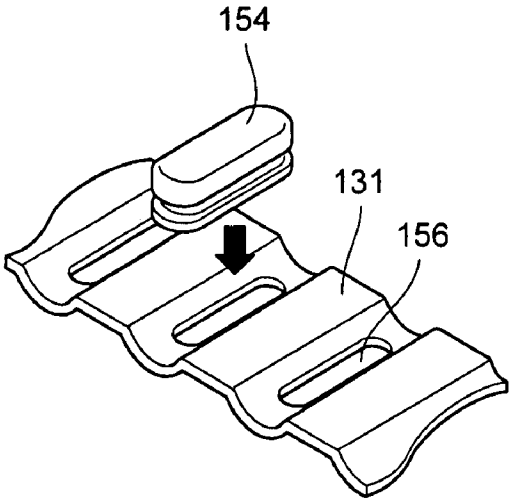
FIGS. 7*a-c* are detailed isometric views of a clip portion of an embodiment similar to the hair retaining clip of FIG. 4.
Figure 7B:
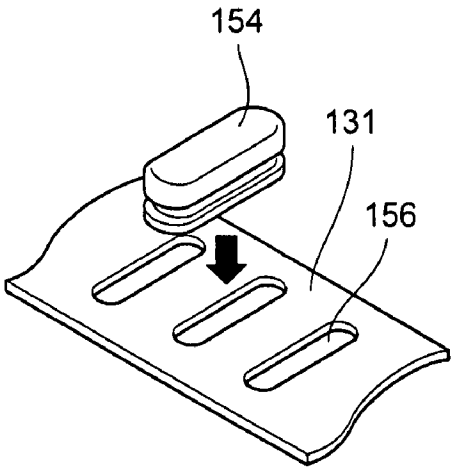
Figure 7A:
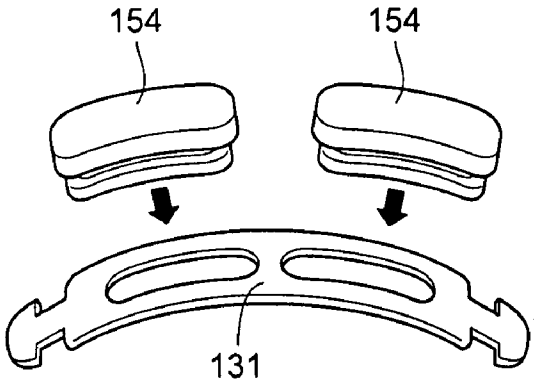

In another exemplary embodiment, as illustrated in FIGS. 7*a-c*, the clip 122 may include one or more inserts 154 that may be disposed generally parallel, perpendicular, and/or diagonal (not shown) to a length of the hair clip 120.

Figure 8:
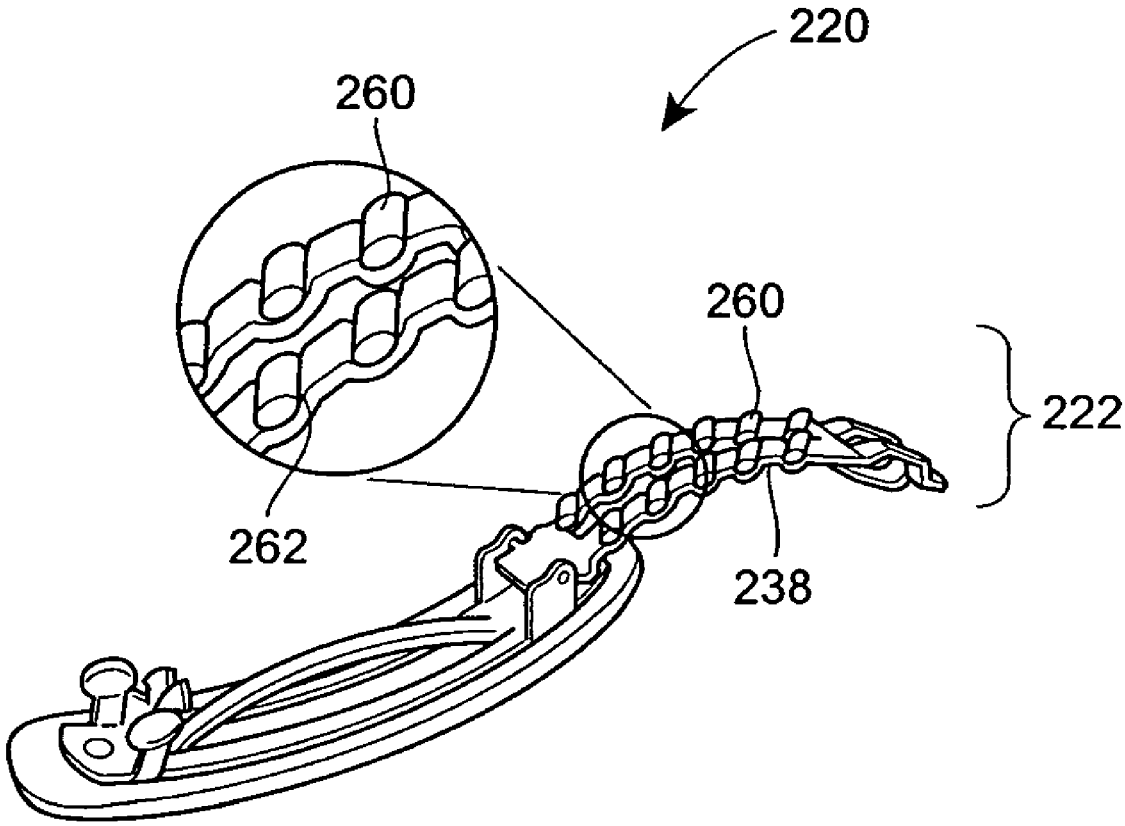
FIG. 8 is an isometric view of another embodiment of a hair retaining clip in an open position.

In another exemplary embodiment, illustrated in FIG. 8, a hair clip 220 includes one or more friction members 260 disposed on a base 238 of a fastener 222. In this exemplary embodiment, the base 238 includes a plurality of recesses, grooves or divots 262 oriented in a generally diagonal direction with respect to the length of the hair clip 220 in which the friction members 260 are disposed. The friction members 260 may, however, be disposed in any direction relative to the length of the hair clip 220. The manner in which the friction members 260 are affixed or connected to the fastener 222 may also vary greatly.

For example, in one embodiment, one or more portions of the fastener 222 may be dipped into a vat of liquid material that then cures to a soft, gripping material. Alternatively, the friction members 260 may be dripped onto one or more portions of the fastener 222. As a result, the fiction member(s) 260 may cover a majority of one or more of the components of the fastener 222 with a contiguous cover of the friction member 260. Additionally, as briefly disclosed above, the fastener 222 may include grooves, recesses, slots, or tabs to aid in securing the friction members 260 and/or to provide additional gripping power. As another alternative, the fastener 222 may be placed in an injection molding machine to undergo an over-molding process in which one or more of the components of the fastener 222 are over-molded with a friction member 260 or insert 154 such that the over-molded portion is non-removable.

Figure 9:
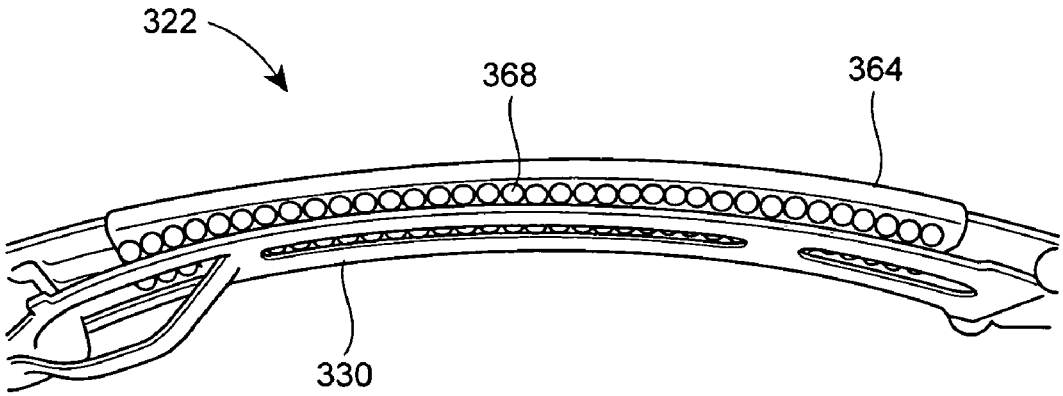
FIG. 9 is an side isometric view of another embodiment of a hair retaining clip in a closed position.
Figure 10:
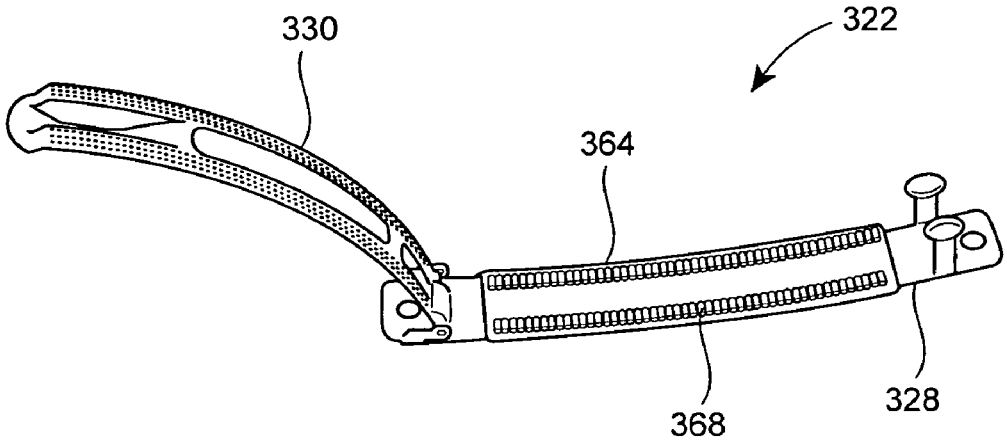
FIG. 10 is an isometric view of the hair retaining clip of FIG. 9 in an open position.
Figure 11:
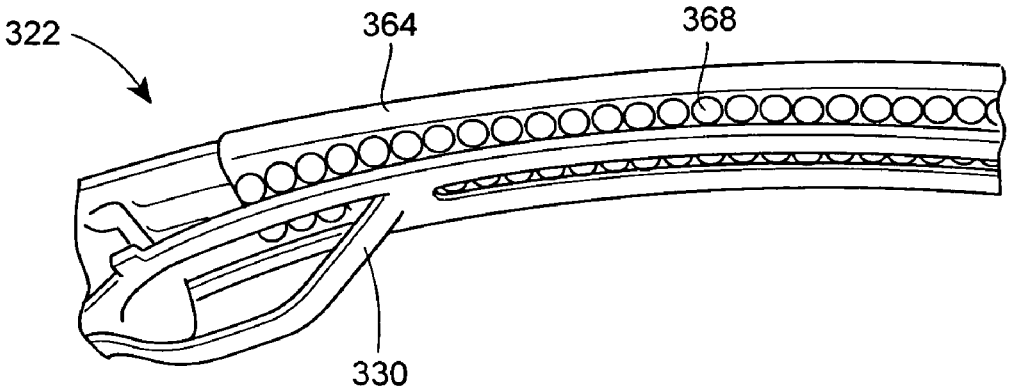
FIG. 11 is a close-up view of the hair retaining clip of FIG. 9.

In a further embodiment as illustrated in FIGS. 9-11, a fastener 322 shown without a shroud includes a sheath or cover 364. Specifically, as seen in FIG. 10, a base 328 of the fastener 322 includes the sheath 364 that surrounds a substantial portion of the base 328. In addition, the sheath 364 may include bumps 368, ridges, or any form of geometry to increase surface area for additional gripping strength. Alternatively, the sheath 364 may be disposed on a lower clip portion 330 or on a spring member (not shown). The sheath 364 may be manufactured separately and then slid or snapped onto the fastener 322 before final forming of the fastener 322 is complete. Alternatively, the sheath 364 may also be manufactured by placing the fastener 322 in an injection molding machine to undergo an over-molding process in which one or more of the components of the fastener 322 are over-molded with a friction member (TPE, silicone, etc.) before final forming of fastener 322 is complete.

Figure 12:
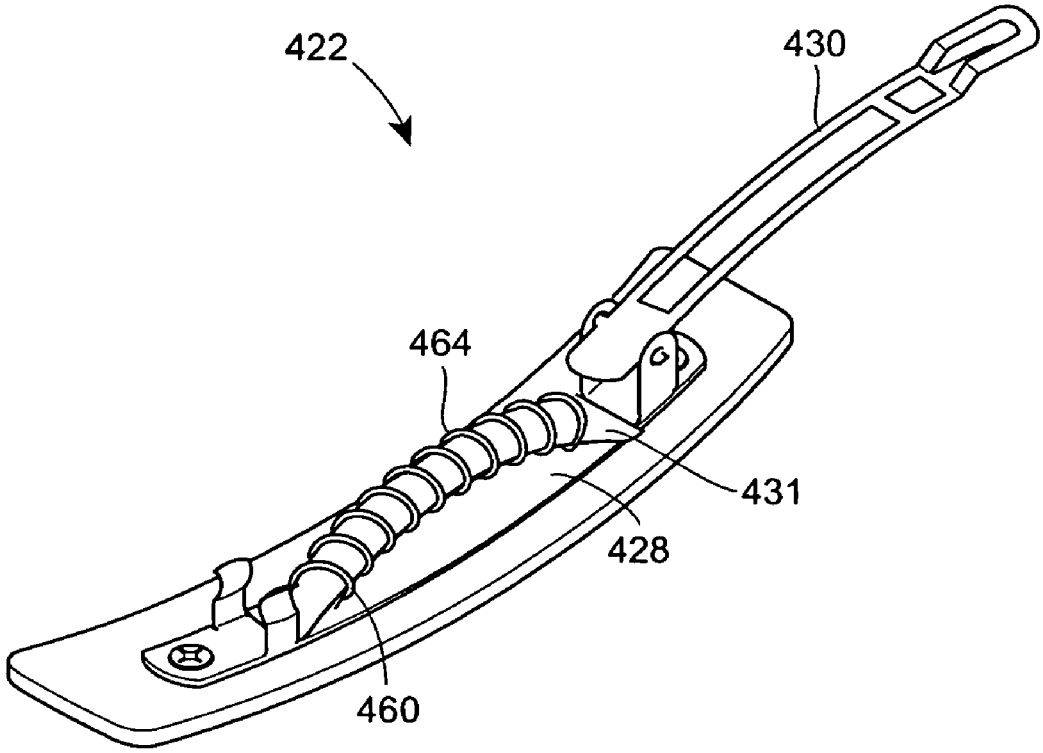
FIG. 12 is an isometric view of another embodiment of a hair retaining clip in an open position.

In another exemplary embodiment as illustrated in FIG. 12, a fastener 422 includes a sheath 464 created by wrapping, coiling or otherwise disposing a band, tape, or other elongate frictional member 460 having a positive frictional property around one or more of a base 428 and a locking arm 430 of the fastener 422. The elongate frictional member 460 may be wrapped in a criss-cross, spiral, or other pattern, and may be affixed to the fastener 422 in several manners. For example, one or more portions of the frictional member 460 may be glued, melted, or otherwise adhered to the fastener 422. Additionally and/or alternatively, the frictional member 460 may be connected to itself such that, for example, a first and second end of the frictional member 460 are connected, thereby connecting the frictional member 460 to the fastener 422.

Figure 13:
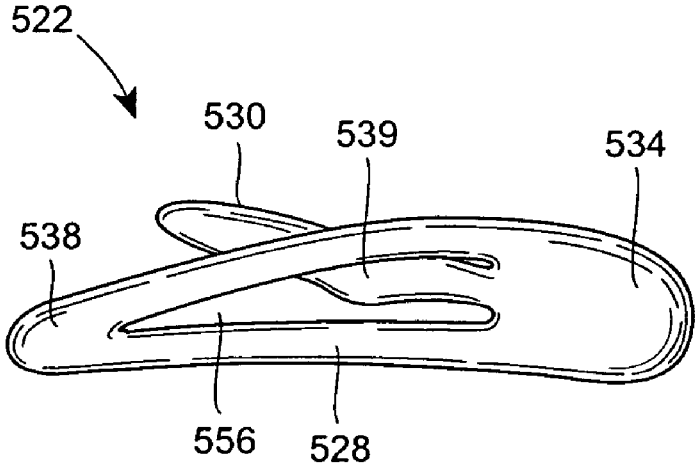
FIG. 13 is an isometric view of another embodiment of a hair retaining clip in an open position.

In another embodiment illustrated in FIG. 13, a hair fastener 522 is shown as a snap clip or contour clip 522, and includes a base 528 and an integral arm 530 that extends from the base 528 and is at least partially disposed on an opening of the base 528. The hair fastener 522 may be constructed from a plastic or metal material capable of providing the biasing force necessary to open and close the fastener 522. Specifically, the fastener 522 as illustrated in FIG. 13 is in an open position such that the base 528 has a convex shape relative to the integral arm 530. More specifically, in the open position, the base 528 has a convex shape such that a free end of the integral arm 530 is disposed apart from the base 528.

In closing the fastener 522, the user forces the base 528 from the convex shape to a concave shape, in essence snapping the fastener 522 from an open position to a closed position. In a closed position, the base 528 has a concave shape complementary to that of the integral arm 530, such that the free end of the integral arm 530 is disposed adjacent the base 528, thereby retaining the hair between the integral arm 530 and the base 528. In other words, the user forces the base 528 from the convex shape to a concave shape, in essence snapping the fastener 522 from an open position to a closed position. The fastener 522 may be dipped into a vinyl bath to produce a gripping surface on the entire fastener 522 or may be provided with an insert pad assembled into an aperture of the fastener 522 or portion of a positive friction member to prevent slippage of the hair. A soft touch paint may also be applied to cover one or more surfaces of fastener 522.

Figure 14:
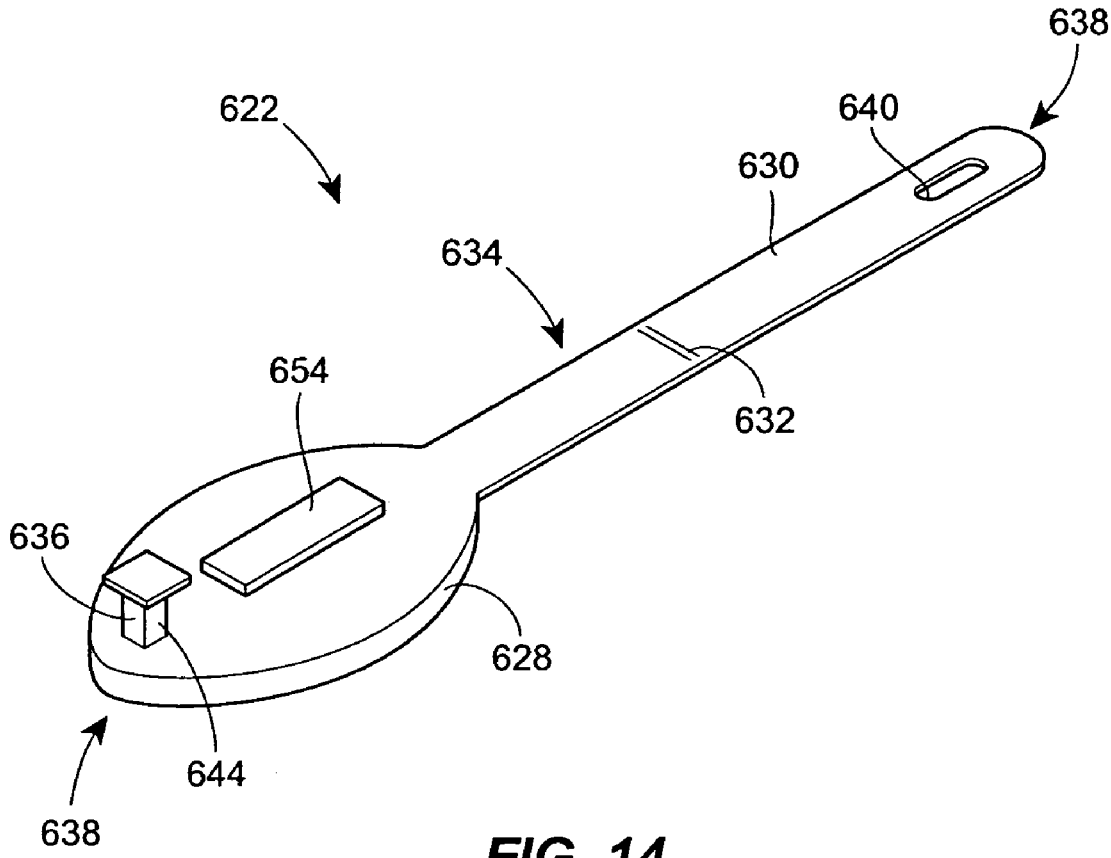
FIG. 14 is an isometric view of another embodiment of a hair retaining clip in an open position.

In a still further embodiment illustrated in FIG. 14, a hair fastener 622 includes a base 628 and an outwardly extending locking arm 630 having a living hinge 632 disposed between proximal and distal ends thereof. The fastener 622 in this embodiment may be constructed from a single molded plastic piece having a first end 634 and a second end 638. The living hinge 632 is disposed at the first end 634 of the fastener 622 and pivotally connects the base 628 to at least a portion of the locking arm 630. A locking mechanism 636 is disposed at the second end 638 of the fastener 622, and secures or locks the fastener 622 in a closed position, when the distal end of the locking arm 630 is folded about the hinge 632 and placed into contact with the locking mechanism 636. The fastener 622, as seen in FIG. 14, is in an open position, thereby providing a detailed view of the locking mechanism 636. The locking mechanism 636 is disposed near an end of the base 628 and comprising a post 644 that engages an aperture 640 disposed at the distal end of the locking arm 630. The clip 622 may be dipped into a vinyl bath to produce a gripping surface on the entire clip 622 or may be provided with a pad or portion of a positive friction member 654 to prevent slippage of the hair. Fastener 622 may further include an aperture (not shown) to allow for an insert to be assembled onto fastener 622 or over-molded with a resilient cushion material such as TPE, silicone, or the like.

Figure 15:
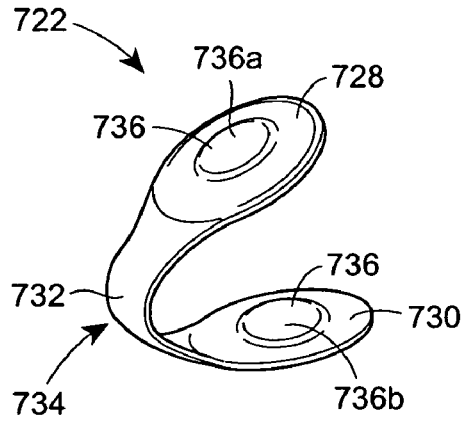
FIG. 15 is an isometric view of another embodiment of a hair retaining clip in an open position.
Figure 16:
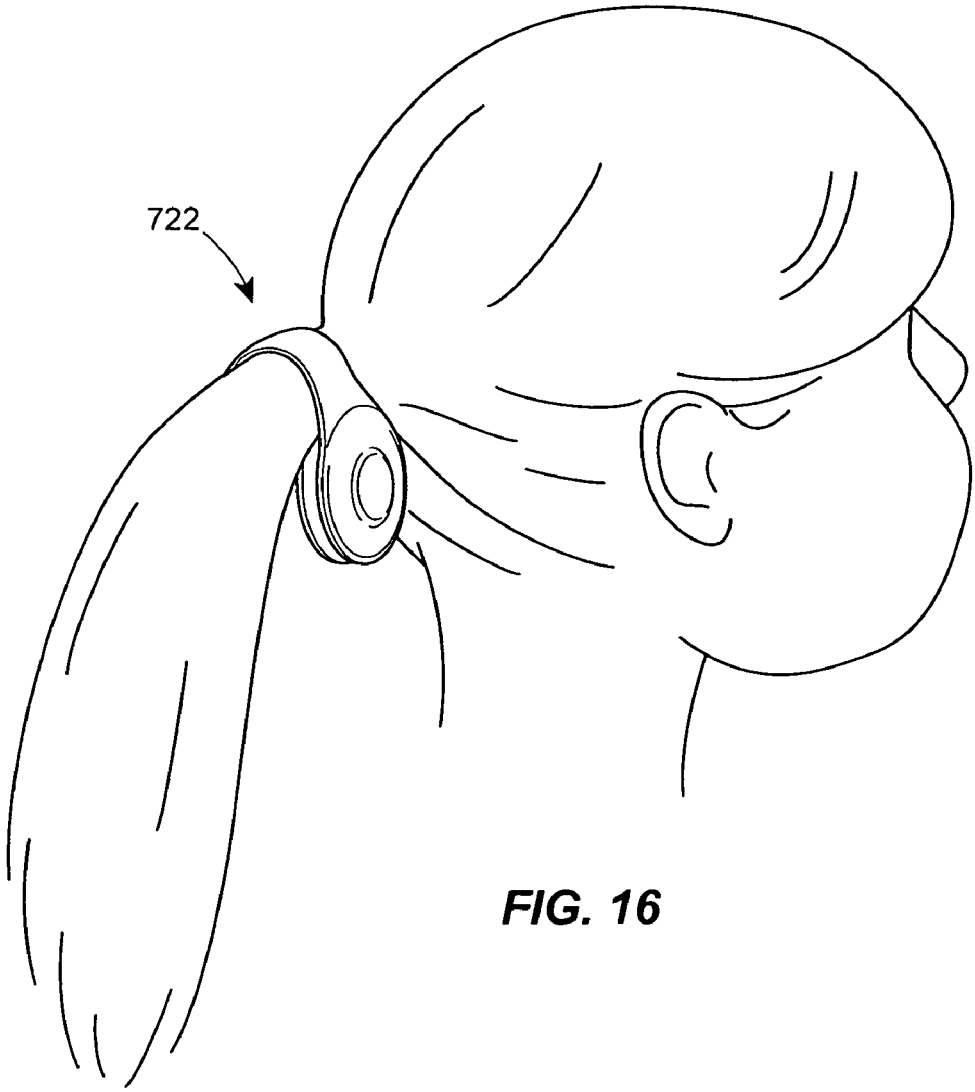
FIG. 16 is an isometric view of the hair retaining clip of FIG. 15 in a closed position retaining a bundle of hair.

In another embodiment, as illustrated in FIG. 15, a fastener 722 includes a first member or half 728 and a second member or half 730. The fastener 722 in this embodiment, may be constructed from one or more pieces of pliable material such as, leather, woven material, etc. A pivot or hinge 732 is disposed at a first end 734 of the fastener 722 and pivotally connects the first member 728 to the second member 730. A locking mechanism 736 is disposed at an opposing end of the fastener 722 and secures or locks the fastener 722 in a closed position. The locking mechanism 736 in this embodiment, includes a first magnet 736*a* disposed near an end of the first member 728 and a second magnet (or metal piece) 736*b* disposed near an end of the second member 730. The magnets 736*a* and 736*b* are positioned such that the magnetic attraction between them secures the first and second members 728, 730 together, as illustrated in FIG. 16. Specifically, the clip 722 may include pockets or openings disposed near the ends of the first member 728 and the second member 730, in which the magnets 736*a* and 736*b* may be placed. The magnetic locking mechanism 736 allows a one-handed actuation of the fastener 722, and allows the consumer to more closely adjust the fastener 722 to the amount of hair that is placed in the fastener 722, due to the lack of a positive locking mechanism. Alternatively, the magnetic locking mechanism 736 may be replaced by a snapping mechanism, such that a male portion of the snap mechanism is disposed on an inside surface of the first member 728 and a female portion of the snap mechanism is disposed on an inside surface of the second member 730.

While the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. A hair retaining clip, comprising:

a base having a first end and a second end, the base including a first elongate section;

a locking arm having a first end and a second end, the locking arm including a spring member including at least one aperture and being constructed of a first material, wherein the first elongate section operatively engages the spring member in a closed position;

a hinge disposed on the first ends of the base and the locking arm, thereby pivotally connecting the base and the locking arm;

a locking mechanism disposed on the second end of the base for locking the clip in a closed position; and an insert disposed in the aperture, wherein the insert is of a unitary construction and is constructed of a second material having a higher coefficient of friction than the first material from which the spring member is constructed, wherein the insert extends along only an intermediate portion of a length of the spring member so that end portions of the spring member are exposed, and wherein the insert extends inwardly from the exposed end portions of the spring member toward the base when the locking arm is in the closed position.

2. The hair retaining clip of claim 1, wherein the insert comprises a groove configured to be received into and aligned with the aperture when the insert is disposed in the aperture.

3. The hair retaining clip of claim 1, wherein the insert has a width and a length that is greater than the width of the insert, and wherein the aperture is oriented such that the length of the insert is parallel to the length of strands of hair of a bundle of hair disposed in and retained by the hair retaining clip.

4. The hair retaining clip of claim 1, wherein the insert has a width and a length that is greater than the width of the insert, and wherein the aperture is oriented such that the length of the insert is perpendicular to the length of strands of hair of a bundle of hair disposed in and retained by the hair retaining clip.

5. The hair retaining clip of claim 1, wherein the spring member includes a plurality of the apertures in series, and wherein the hair retaining clip comprises a plurality of inserts each disposed in a corresponding one of the apertures of the spring member.

6. A hair retaining clip for securing a bundle of hair, comprising:

a base having a first end and a second end;

a locking arm having a first end and a second end;

a hinge pivotally connecting the first end of the base to the first end of the locking arm such that the locking arm is movable between an open position and a closed position;

a locking mechanism connected to the base proximate the second end of the base and configured to releasably engage the second end of the locking arm when the locking arm is moved to the closed position to retain the locking arm in the closed position;

a spring member connected to the locking arm and constructed of a first material; and a plug connected to the spring member and having an inner portion disposed facing the base when the locking arm is in the closed position, with the plug being urged by the spring member to engage strands of the bundle of hair disposed between the plug and the base to retain the hair clip on the bundle of hair, wherein the plug is of a unitary construction and is constructed of a second material having a higher coefficient of friction than the first material from which the spring member is constructed so that the plug grips the bundle of hair better than the spring member.

7. The hair retaining clip of claim 6, wherein the spring member includes an aperture, and wherein the plug is disposed within the aperture of the spring member.

8. The hair retaining clip of claim 7, wherein the plug comprises a groove configured to be received into and aligned with the aperture when the plug is disposed in the aperture.

9. The hair retaining clip of claim 8, wherein the plug includes a pair of protruding ledges that define the groove therein and wherein the pair of protruding ledges are resiliently deflectable so that the plug can be inserted into the aperture by a press fit for ease of replacement.

10. The hair retaining clip of claim 6, wherein the plug has a width and a length that is greater than the width of the plug, and wherein the plug is oriented such that the length of the plug is parallel to the length of strands of hair of a bundle of hair disposed in and retained by the hair retaining clip.

11. The hair retaining clip of claim 6, wherein the plug has a width and a length that is greater than the width of the plug, and wherein the plug is oriented such that the length of the plug is perpendicular to the length of strands of hair of a bundle of hair disposed in and retained by the hair retaining clip.

12. The hair retaining clip of claim 6, wherein the spring member includes a plurality of the apertures in series, and wherein the hair retaining clip comprises a plurality of plugs each disposed in a corresponding one of the apertures of the spring member.

13. The hair retaining clip of claim 6, wherein the plug comprises an engagement element configured to mate with the spring member when disposed in the aperture of the spring member.

14. The hair retaining clip of claim 13, wherein the engagement element is a groove defined between a pair of protruding portions.

15. The hair retaining clip of claim 6, wherein the plug extends along only an intermediate portion of a length of the spring member so that end portions of the spring member are exposed, and wherein the inner portion of the plug extends inwardly from the exposed end portions of the spring member toward the base when the locking arm is in the closed position.

16. A clip for retaining a bundle of a user's hair, comprising:

a base having a first end and a second end;

a locking arm having a first end and a second end;

a hinge pivotally connecting the first end of the base to the first end of the locking arm such that the locking arm is pivotally movable between an open position and a closed position;

a locking mechanism connected to the base proximate the second end of the base and configured to releasably engage the second end of the locking arm when the locking arm is moved to the closed position to retain the locking arm in the closed position;

a spring member made of a first material, connected to the locking arm, and defining an aperture; and an insert disposed within the aperture of the spring member, wherein the insert has an inner portion disposed facing the base when the locking arm is in the closed position, wherein the insert is of a unitary construction and is made of a second material having a higher coefficient of friction than the first material from which the spring member is made, wherein the insert defines at least one peripheral groove that receives a rim portion of the spring member adjacent the aperture when the insert is disposed in the aperture, wherein the insert includes at least one pair of protruding ledges that define the groove therebetween, the pair of protruding ledges being resiliently deflectable so that the insert can be inserted into the aperture by a press fit by the user and thereby easily replaced in the aperture by the user, wherein the inner portion of the insert is urged by the spring member to engage at least a portion of the bundle of hair disposed between the insert and the base to retain the hair clip on the bundle of hair when the locking arm is in the closed position, wherein the insert extends along only an intermediate portion of a length of the spring member so that end portions of the spring member are exposed, and wherein the inner portion of the insert extends inwardly from the exposed end portions of the spring member toward the base when the locking arm is in the closed position so that any excess portion of the bundle of hair is received between the exposed end portions of the spring member and the base.

17. The hair clip of claim 16, wherein the insert plugs into an aperture in the locking arm or the base, and wherein the hair clip does not include the spring member.

18. The hair clip of claim 16, wherein the spring member with the aperture and the insert is a part of the base instead of a part of the locking arm.

* * * * *